US005078252A

United States Patent [19]

Furuya et al.

[11] Patent Number: 5,078,252

[45] Date of Patent: Jan. 7, 1992

[54] COIN SELECTOR

[75] Inventors: Yonezo Furuya, Saitama; Kenji Nishiumi, Sakado; Ichiro Fukuda, Kawagoe, all of Japan

[73] Assignee: Kabushiki Kaisha Nippon Conlux, Tokyo, Japan

[21] Appl. No.: 391,065

[22] Filed: Aug. 9, 1989

[30] Foreign Application Priority Data

Apr. 10, 1989 [JP] Japan ..... 1-90380

[51] Int. Cl.[5] ..... G07D 5/08

[52] U.S. Cl. ..... 194/318; 324/243

[58] Field of Search ..... 194/302, 303, 317, 318, 194/319; 324/239, 240, 241, 242, 243

[56] References Cited

U.S. PATENT DOCUMENTS

| | | | |
|---|---|---|---|
| 2,540,063 | 1/1951 | Victoreen | 194/318 |
| 3,152,677 | 10/1964 | Phillips | 194/318 |
| 3,952,851 | 4/1976 | Fougere et al. | 194/317 |
| 4,086,527 | 4/1978 | Cadot | 324/239 X |
| 4,091,908 | 5/1978 | Hayashi et al. | 194/318 |
| 4,124,111 | 11/1978 | Hayashi | 194/334 |
| 4,286,704 | 9/1981 | Wood | 194/318 |
| 4,353,452 | 10/1982 | Shah et al. | 194/317 |
| 4,371,073 | 2/1983 | Dubey | 194/334 |
| 4,441,602 | 4/1984 | Ostroski et al. | 194/318 |
| 4,660,705 | 4/1987 | Kai et al. | 194/318 |
| 4,680,566 | 7/1987 | Goseberg et al. . | |
| 4,705,154 | 11/1987 | Masho et al. | 194/319 |
| 4,742,903 | 5/1988 | Trummer | 194/317 |
| 4,749,074 | 6/1988 | Ueki et al. | 194/317 |
| 4,754,862 | 7/1988 | Rawicz-Szcerbo et al. | 194/319 |
| 4,806,831 | 2/1989 | Goseberg et al. . | |
| 4,951,799 | 8/1990 | Kai | 194/317 |
| 4,954,777 | 9/1990 | Klopfer et al. | 324/241 X |
| 4,995,497 | 2/1991 | Kai et al. | 194/318 |
| 4,998,610 | 3/1991 | Said et al. | 194/318 |

FOREIGN PATENT DOCUMENTS

| | | | |
|---|---|---|---|
| 95698 | 8/1977 | Japan . | |
| 123298 | 10/1977 | Japan . | |
| 130697 | 11/1977 | Japan . | |
| 7400 | 1/1978 | Japan . | |
| 53-65790 | 12/1978 | Japan | 194/318 |
| 82004 | 6/1980 | Japan . | |
| 157088 | 12/1980 | Japan . | |
| 11181 | 3/1981 | Japan . | |
| 59387 | 5/1981 | Japan . | |
| 51396 | 12/1981 | Japan . | |
| 6191 | 2/1983 | Japan . | |
| 6985 | 2/1983 | Japan . | |
| 11154 | 3/1984 | Japan . | |
| 14978 | 4/1984 | Japan . | |
| 151523 | 1/1962 | U.S.S.R. | 194/318 |
| 884720 | 12/1961 | United Kingdom | 194/318 |
| 2045500 | 10/1980 | United Kingdom | 194/318 |

*Primary Examiner*—Frank E. Werner
*Assistant Examiner*—Scott L. Lowe
*Attorney, Agent, or Firm*—Diller, Ramik & Wight

[57] ABSTRACT

A coin selector comprises a first receiving coil and a first exciting coil disposed along one side of a coin path, a second receiving coil and a second exciting coil disposed along the other side of the coin path facing the first receiving coil and the first exciting coil, and drive devices for exciting and driving the first and second exciting coils. A magnetic field developed by the first exciting coil acts on the first and second receiving coils and a magnetic field developed by the second excitign coil acts on the second and first receiving coils. The coin selector further comprises judging devices. When a coin is put into and passes through the coin path, the magnetic fields presented to the first and second receiving coils change and consequence a change in the output voltages of these coils. The judging devices judge the coin passing through the coin path on the basis of the sum of the output signals of the first and second receiving coils.

24 Claims, 12 Drawing Sheets

COIN SELECTOR

BACKGROUND OF THE INVENTION

1. Field of the Invention

The present invention relates to a coin selector in use with various types of service machines such as a vending machine and a coin exchanging machine, and more particularly to a coin selector of the type in which different types of coins are sorted by electronically recognizing the materials or other properties of the coins.

2. Description of the Related Art

An example of the conventional coin selectors of the type which electronically sorts coins is disclosed in U.S. Pat. No. 3870137. The coin selector is so arranged that a coil of an oscillator is disposed along one side of a coin path. The coin selector electronically recognizes the type of a coin in accordance with a deviation of an oscillating frequency of the oscillator, which deviation is caused when the coin passes through the coin path. There are so-called cladding coins, such as 10 cent, 25 cent and one dollar coins. The cladding coin is formed by laminating thin layers of different materials. The cladding coins cannot be detected by using a single oscillator generating a signal of a single frequency. As is well known, when a magnetic field is applied to a coin, magnetic fluxes in a magnetic field alternating at a low frequency penetrates deeply into the coin, while magnetic fluxes in a magnetic field alternating at a high frequency act only in the surface region of the coin. Accordingly, a coin selector whose oscillator oscillates at a frequency so selected as to detect the material of the inner portion of a coin, cannot detect the material of the surface of the coin. To the contrary, a coin selector whose oscillator oscillates at a frequency so selected as to detect the material of the surface of a coin, cannot detect the material of the inner portion of the coin. To cope with this problem, the coin selector disclosed in the U.S. Pat. No. 3870137 uses a plurality of coils arrayed along the coin path, and a plurality of oscillators in connection with the coils. The oscillating frequencies of the oscillators are made different from one another so as to detect the cladding coins. This approach, however, creates another problem that the array of the plurality of coils along the coin path results in an elongation of the coin path, and consequently an increase of a size of the coin selector. The approach has a further problem that the provision of the plurality of oscillators oscillating at different frequencies requires an intricated circuit arrangement.

In the coin selector of the U.S. Pat. No. 3870137, the coin path is inclined by a predetermined angle with respect to a vertical line. This is done to prevent a coin passing through the coin path from moving in a direction transverse to the path so as to maintain a fixed relationship of the coils arrayed on one side of the coin path and the coin passing through the coin path. If the coin path is arranged exactly vertically, distance between a passing coin and the coils changes as the coin moves transversely in the coin path. As the distance between the coin and the coils changes, the deviation of the oscillating frequency of the oscillator changes. Therefore, the coin selector mistakenly recognizes the types of the passing coin. However, the inclined arrangement of the coin path creates another problem. In the arrangement, a coin slides along one side wall of the coin path. When the coin is wet, it tends to jam in the path. Further, in the arrangement, dusty materials tend to deposit on the side wall of the path. When dust is deposited to a certain thickness on the sidewall, a magnetic coupling between a coin and each coil changes. Therefore, a coin sliding down the dusty side wall provides an output signal different from the output signal when the same coin slides down on a clean side wall of the coin path. This degrades an accuracy of the coin selection of the coin selector, and possibly causes frequent improper operations of the coin selector. Further, the inclined arrangement of the coin path requires a larger space. This leads to an increased size of the coin selector.

SUMMARY OF THE INVENTION

Accordingly, an object of the present invention is to provide a coin selector which is simple in construction and is able to discriminately recognize the types of coins stably and accurately.

According to one aspect of the present invention, there is provided a coin selector comprising a first receiving coil disposed along a coin path, a first exciting coil so disposed as to magnetically couple with the first receiving coil, a second receiving coil disposed facing the first receiving coil with respect to the coin path, a second exciting coil so disposed as to magnetically couple with the second receiving coil, drive means for exciting and driving the first and second exciting coils, and judging means for judging a coin passing through the coin path on the basis of a signal representing the sum of the output signals of the first and second receiving coils.

According to another aspect of the present invention, there is provided a coin selector comprising a first receiving coil disposed along a coin path, a first exciting coil so disposed as to magnetically couple with the first receiving coil, a second receiving coil disposed facing the first receiving coil with respect to the coin path, a second exciting coil so disposed as to magnetically couple with the second receiving coil, drive means for driving the first and second exciting coils, coin diameter detecting means disposed along the coin path for detecting a diameter of a coin passing through the coin path, and judging means for judging a coin by determining properties of a coin passing through the coin path on the basis of a signal representing the sum of the output signals of the first and second receiving coils, and by determining a diameter of the coin passing through the coin path on the basis of an output of the diameter detecting means.

The first and second exciting coils are driven by the drive means. A magnetic field developed by the first exciting coil acts on the first and second receiving coils. A magnetic field developed by the second exciting coil acts on the second and first receiving coils. When a coin is put into and passes through the coin path, the magnetic fields of the first and second receiving coils and consequence the output signals of those coils change. The recognizing means recognizes properties a passing coin in accordance with a signal representing the sum of the output signals of the first and second receiving coils. The coin diameter detecting means detects a diameter of the passing coin in the coin path.

With such an arrangement, the coin selector is simple in construction and reduced in size, and is able to exactly recognize the properties of a passing coin in the coin path. The arrangement of the coin selector allows the coin path to be set vertically, not obliquely. The coin selector using a vertically arrayed coin path is free from the problems of the dusty material deposition and coin jamming in the coin path, that are essential to the obliquely arrayed coin path structure. Therefore, a stable and exact recognition of the properties of coins may be realized.

BRIEF DESCRIPTION OF THE DRAWINGS

FIG. 9(*b*) shows a sectional view taken on line 9B—9B of FIG. 9(*a*);

FIG. 10(*b*) shows a sectional view taken on line 10B—10B in FIG. 10(*a*);

FIG. 11(*b*) shows a sectional view taken on line 11B—11B in FIG. 11(*a*);

DETAILED DESCRIPTION OF THE PREFERRED EMBODIMENTS

Figure 1:
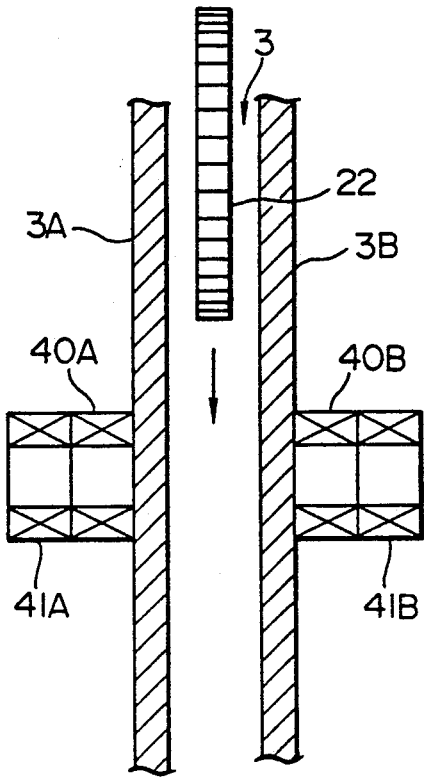
FIG. 1 is a diagram showing a fundamental configuration of a coin detecting section employed in the present invention.

FIG. 1 is a sectional view of a part of a coin detecting section employed in a coin selector according to the present invention. In FIG. 1, a first receiving coil 40A is disposed on one side wall 3A of a coin path 3 through which a coin 22 passes. A second receiving coil 40B is disposed on the other side wall 3B such that it is arranged to be coaxial with the first receiving coil 40A. A first exciting coil 41A is disposed adjacent to and coaxial with the first receiving coil 40A. A second exciting coil 41B is disposed adjacent to and coaxial with the second receiving coil 40B.

Figure 2:
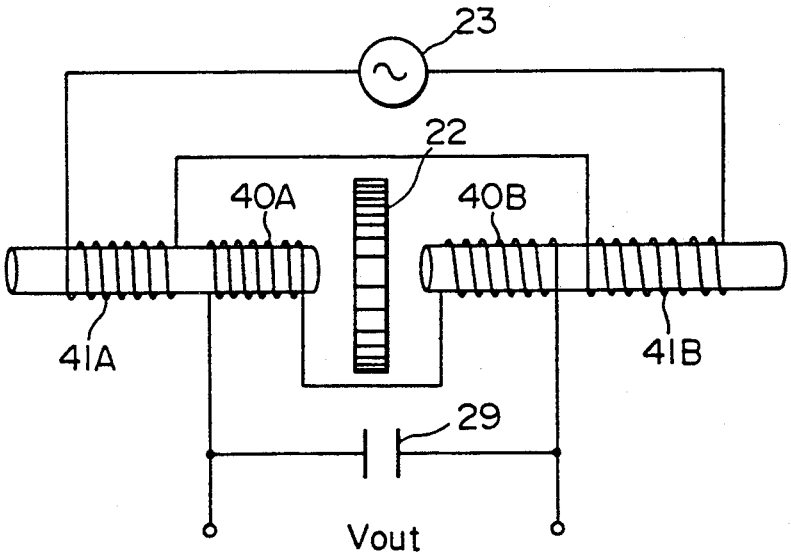
FIG. 2 is a circuit diagram used in the configuration of FIG. 1.

FIG. 2 shows connections of the first and second exciting coils 41A and 41B, and first and second receiving coils 40A and 40B. The first and second exciting coils 41A and 41B are connected in series to each other, and are energized by a single drive source 23. The first and second receiving coils 40A and 40B are also connected in series with each other. The series circuit of the first and second receiving coils 40A and 40B is connected in parallel with a capacitor 29. The type of a coin 22 put into the coin path 3 is recognized on the basis of an output voltage $V_{OUT}$ of the series circuit of the first and second receiving coils 40A and 40B.

The first and second exciting coils 41A and 41B are energized by an AC signal alternately inverting its polarity at predetermined periods that is derived from the drive source 23. Accordingly, first and second states are alternately set up in the first and second exciting coils 41A and 41B in accordance with the alternately changing polarities of the AC signal.

Figure 3:
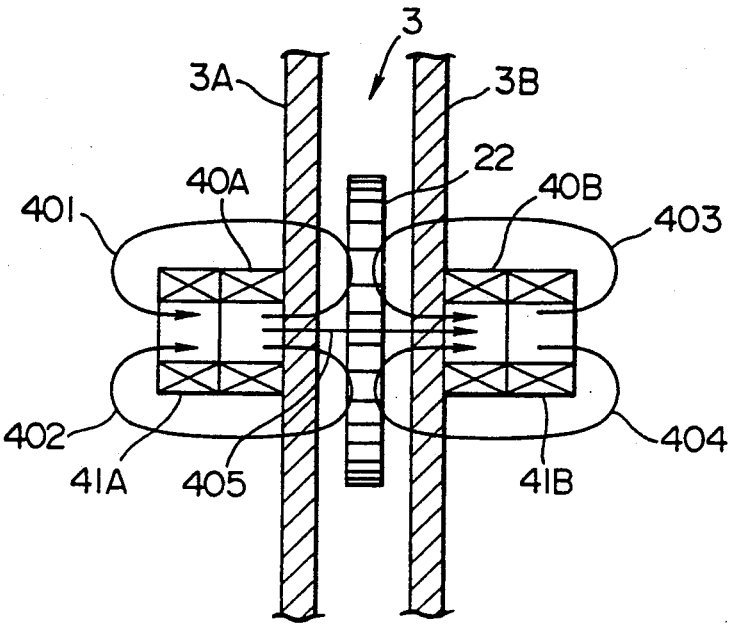
FIGS. 3 through 6 are diagrams useful in explaining the operation of the FIG. 1 configuration.
Figure 4:
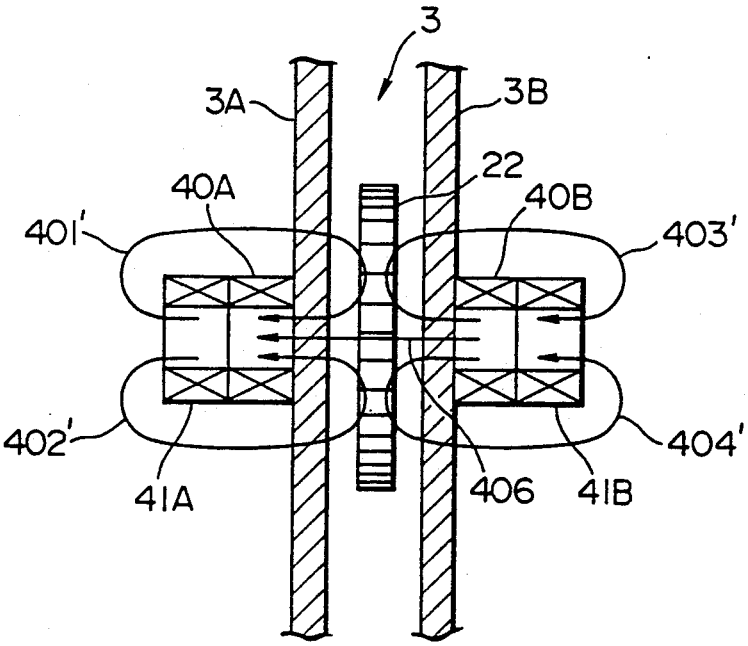

FIG. 3 shows a state of magnetic fluxes in the first state, and FIG. 4 a state of magnetic fluxes in the second state.

Referring to FIG. 3, in the first state before the coin 22 is put into the coin path 3, magnetic fluxes 401 and 402 developed by the exciting coil 41A pass through the receiving coil 40A, to induce in the receiving coil 40A a voltage corresponding to the magnetic fluxes 401 and 402. Also in this state, magnetic fluxes 403 and 404 developed by the exciting coil 41B pass through the receiving coil 40B, and magnetic flux 405, which is a part of magnetic fluxes developed by the exciting coil 41A, passes through the receiving coil 40B. As a result, a voltage is induced in the receiving coil 40B by the magnetic fluxes 403, 404, and 405.

Referring to FIG. 4, in the second state before the coin 22 is put into the coin path 3, magnetic fluxes 401' and 402' developed by the exciting coil 41A pass through the receiving coil 40A, and magnetic flux 406 which is a part of magnetic fluxes developed by the exciting coil 41B, passes through the receiving coil 40A. As a result, a voltage is induced in the receiving coil 40A by the magnetic fluxes 401', 402', and 406.

Also in this state, magnetic fluxes 403' and 404' developed by the exciting coil 41B pass through the receiving coil 40B, to induce in the receiving coil 40B a voltage corresponding to the magnetic fluxes 403' and 404'.

In FIGS. 3 and 4, it is assumed now that under these conditions, the coin 22 is put into the coin path 3. The magnetic fluxes 401, 402, 401' and 402' that are developed by the exciting coil 41A, when they reach the coin 22, are influenced by an eddy current generated in the surface part of the coin 22, and hence change. The change of the magnetic fluxes causes the induced voltage in the receiving coil 40A to change. In the same manner, the magnetic fluxes 403, 404, 403', and 404' that are developed by the exciting coils 41B, when they read the coin 22, are influenced by an eddy current generated in a surface part of the coin 22, and change. The change of the magnetic fluxes causes the reduced voltage in the receiving coil 40B to change. On the other hand, the magnetic fluxes 405 and 406 penetrate into and passes through the coin 22. During the passage of the fluxes, the fluxes 405 and 406 are influenced by the material of the coin 22 in its central part, so as to change the induced voltages in the receiving coils 40B and 40A, respectively. In this way, the voltage $V_{OUT}$, which is the sum of the output voltages of the receiving coils 40A and 40B, changes in accordance with the materials of the coin 22 in the surface and central parts. In other words, voltage $V_{OUT}$ contains the information different materials of the coin in the surface and central portions.

Figure 5:
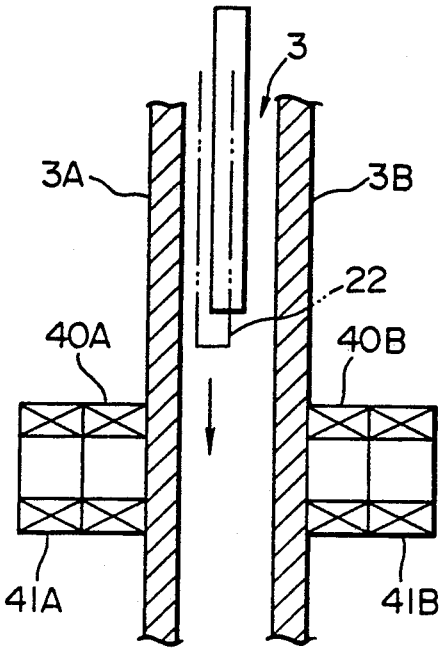
Figure 6:
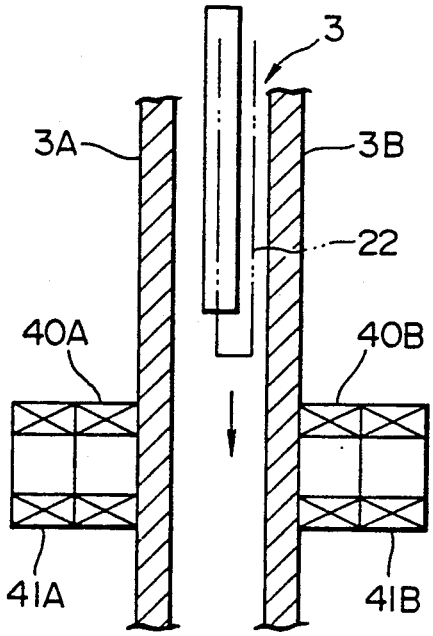

The output voltages of the receiving coils 40A and 40B also change in accordance with a distance between the coils and the coin 22 as the coin 22 passes through the coin path. When the coin 22 traces a path at the center of the coin path so that it maintains the equal distance from the receiving coils 40A and 40B, the voltages induced in the receiving coils 40A and 40B are equal to each other. However, when the coin traces a path deviated toward the receiving coil 40A from the center of the coin path as shown in FIG. 5, the influence by the coin 22 on the receiving coil 40A increases and an output signal of the receiving coil 40A increases. On the other hand, the influence by the coin 22 on the receiving coil 40B decreases and an output signal of the coil 40B decreases. Similarly, when the coin traces a path deviated toward the receiving coil 40B from the center of the coin path as shown in FIG. 6, the influence by the coin 22 on the receiving coil 40B increases and an output signal of the coil 40B increases. On the other hand, the influence by the coin 22 on the coil 40A decreases and an output signal of the coil 40A decreases. Whatever paths the coin may trace, the summation of the induced voltages of the receiving coils 40A and 40B is always constant.

With the connection of the receiving coils 40A and 40B as shown in FIG. 2, the induced voltages of the receiving coils 40A and 40B are summed to cancel the influences due to the transverse displacement of the path traced by the coin 22 in the coin path 3.

Figure 7:
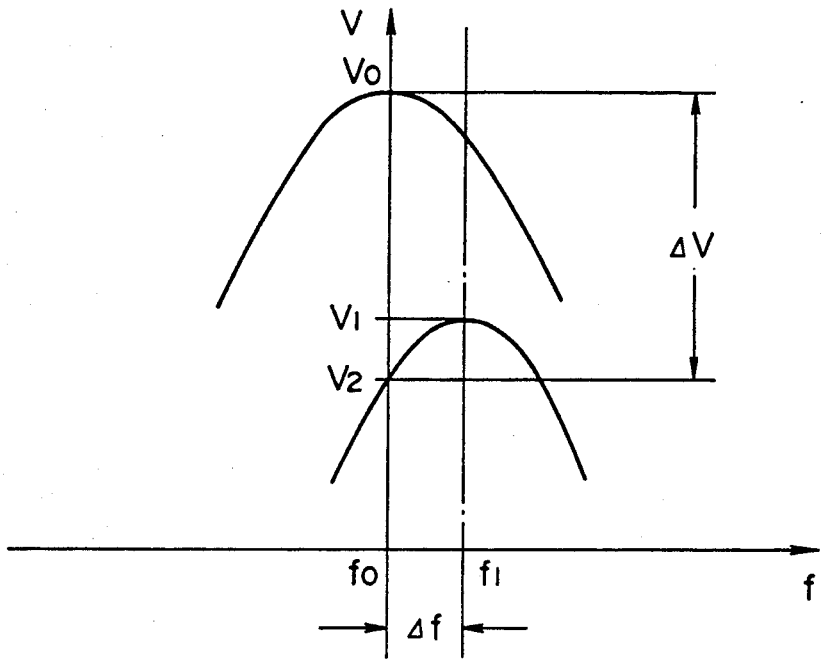
FIGS. 7 and 8 are graphical representations of the output characteristics of the circuit of FIG. 2.

FIG. 7 is a graph showing a variation of the output voltage $V_{OUT}$ of the circuit of FIG. 2 when the coin 22 passes through the coils, with the abscissa representing a frequency of the exciting voltage and the ordinate representing the output voltage $V_{OUT}$. In FIG. 7, if the exciting frequency is set at "fo", the output voltage $V_{OUT}$ shows Vo before the coin 22 is put into the coin path. Under this condition, the output voltage $V_{OUT}$ exhibits a peak voltage Vo at the frequency "fo". When the coin 22 is put into the coin path 3, inductances of the receiving coils 40A and 40B change and the frequency at which the output voltage $V_{OUT}$ exhibits a peak value, changes. Assuming that the inductances of the receiving coils 40A and 40B before the coin 22 is put into the path are L1 and L2, and that a capacitance of the capacitor 29 is C, the resultant inductance of the coils 40A and 40B is $L=L1+L2$, and the output voltage $V_{OUT}$ exhibits a maximum value at frequency "fo" ($=\frac{1}{2}\pi\sqrt{LC}$). When the coin 22 is put into the coin path 3, the resultant inductance L changes to an inductance L', and a frequency at which the output voltage $V_{OUT}$ exhibits a maximum voltage change to $f1=\frac{1}{2}\pi\sqrt{L'C}$. The frequency difference f is $\frac{1}{2}\sqrt{\pi L'C}-\frac{1}{2}\pi\sqrt{LC}$.

The peak value of the output voltage $V_{OUT}$ changes from Vo to Vl as the coin 22 passes through the coils. At the frequency of fo, the output voltage $V_{OUT}$ changes V2 due to the coin 22 passing through the coils. A voltage difference $\Delta V$ ($=V0-V2$) depends on the materials of the coin 22. Therefore, the voltage difference $\Delta V$ is employed to discriminate the types of coins in this embodiment.

Figure 9:
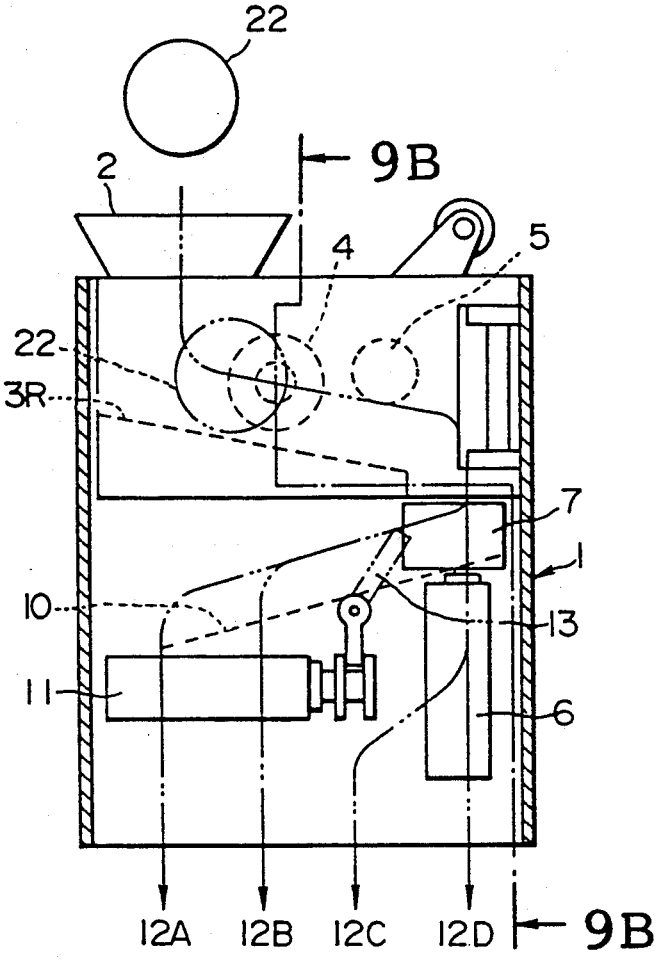
FIG. 9(*a*) shows a sectional view of an embodiment of a coin selector according to the present invention as viewed from the front.
Figure 9:
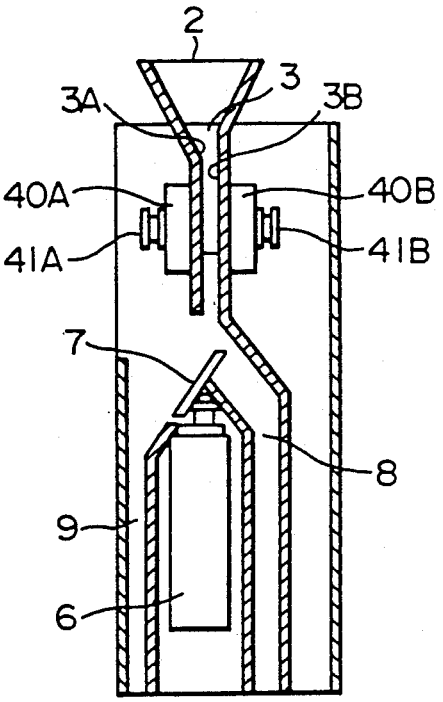

FIGS. 9(*a*) and 9(*b*) show an overall configuration of an embodiment of a coin selector according to the present invention in which FIG. 9(*a*) shows a sectional view of the coin selector as viewed from the front side of the selector, and FIG. 9(*b*) shows a sectional view taken on line 9B—9B in FIG. 9(*a*). In FIGS. 9(*a*) and 9(*b*), like reference symbols are used for designating like or equivalent portions in the basic configuration shown in FIG. 1.

In these drawings, a slot 2 is provided at the top of a main frame of the coin selector 1. The coin 22 as put into the slot 2 drops on a first rail 3R slanted down in the direction going away from the slot 2. The coin 22 drops and rolls down on the rail 3R. A coil 4 for detecting the materials and construction of the coin and a coil 5 for detecting the size of it are disposed around the middle of the rail 3R. A processing to discriminately select coins passing through the coin path is conducted based on the outputs of the coils 4 and 5, which will be described later.

A solenoid 6 is energized in response to the validity of the coin 22 as put in, under control of the coin select processing previously conducted. When it is energized, a gate 7 is driven to allow the coin to go to a true coin path 8, if the coin is true. If the coin is false, the coin is directed to a false coin path 9. More specifically, in the case of the false coin, the solenoid 6 is not energized and the gate 7 lies in the true coin path 8. Accordingly, the coin is directed into the false coin path 9. When the coin is true, the solenoid 6 is energized to retract the gate 7 from the true coin path 8 in which the gate 7 is placed in a stand-by state, to allow the true coin to go into the true coin path 8.

The coins led to the path 8 are sorted into groups of coins A and B, and C and D in accordance with the denominations of coins. When the coin belongs to the group of the coins of the denomination A or B, the solenoid 11 is driven and the lever 13 is rotated clockwise in FIG. 9(*a*), and the path leading to the group the coin of the denomination C or D is closed, and the coins of the denomination A or B are led to the rail 10. When the coins are of the denomination C or D, the solenoid 11 is not driven and the coins pass under the coin path 8.

The coin of the denomination A or B led to the rail 10 is directed to either of paths 12A and 12B in accordance with the size of the coin. The coin of the denomination C or D passed through the true coin path 8 is directed to either of paths 12C and 12D in accordance with the size of the coin. The coin led to the false path 9 is discharged through an exit (not shown).

The coil 4 for recognizing properties of a coin, such as material, size and surface conditions of the coin, has substantially the same basic configuration as that of FIG. 1, and is composed of the receiving coils 40A and 40B, and the exciting coils 41A and 41B.

Figure 10A:
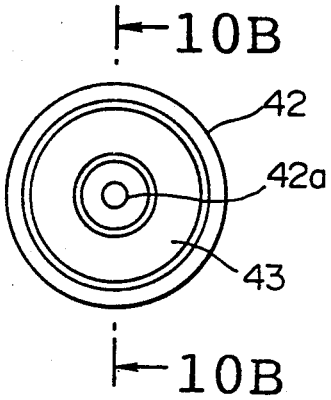
FIG. 10(*a*) shows a front view showing an example of a pot type coil used as a receiving coil.
Figure 10B:
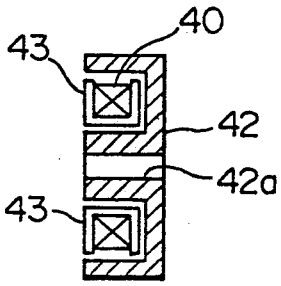

The receiving coils 40A and 40B, as shown in FIG. 10(*a*) showing its front view and FIG. 10(*b*) showing a sectional view taken on line 10B—10B FIG. 10(*a*), are each made up of a pot type coil arranged such that a coil 40 wound around a bobbin 43 is disposed in a pot type core 42 having a cylindrical bore 42*a* at the center.

Figure 11A:
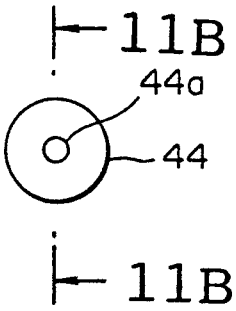
FIG. 11(*a*) shows a front view of an example of a drum type coil used as an exciting coil.
Figure 11B:
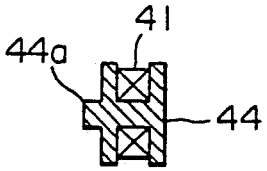

The exciting coils 41A and 41B, as shown in FIG. 11(*a*) showing its front view and in FIG. 11(*b*) showing a sectional view taken on line 11B—11B in FIG. 11(*a*), are each made of a drum type coil arranged such that a coil 41 is wound around a drum type core 44 with a projection 44*a* at the center, that will be fitted into the bore 42*a* of the pot type core 42. The core 42 for the pot type coil and the core 44 for the drum type coil may be made of magnetic material such as ferrite. The bobbin 43 for the pot type coil may be made of nonmagnetic material such as plastic.

Figure 12:
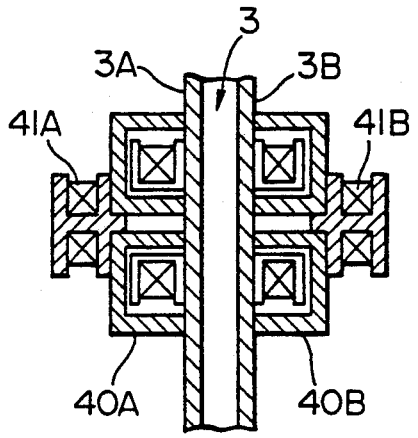
FIG. 12 is a partial sectional view showing how a coil for recognizing the type of a coin is mounted.

The receiving coils 40A and 40B and the exciting coils 41A and 41B, that are structured as shown above, are arranged as shown in FIG. 12. The projection 44*a* located at the central part of the exciting coil 41A is fitted into the bore 42*a* of the receiving coil 40A. Under this condition, the surface of the receiving coil 40*a* that is opposite to the mounting surface of the exciting coil 41A is tightly mounted on the side wall 3A of the coin path 3. In the same manner, the exciting coil 41B is fitted to the receiving coil 40B, and then is mounted on the side wall 3B of the coin path 3 such that he axis of the exciting coil 41B and the receiving coil 40B is aligned with that of the exciting coil 41A and the receiving coil 40A mounted on the side wall 3A.

Figure 13:
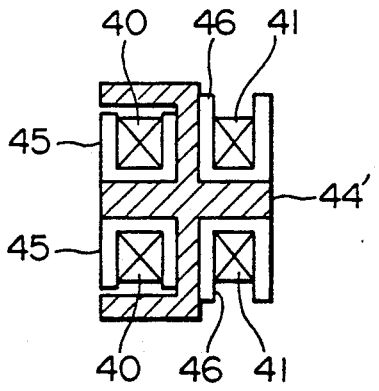
FIGS. 13 and 14 show sectional views showing configurations of other coils for recognizing the type of a coil.
Figure 14:
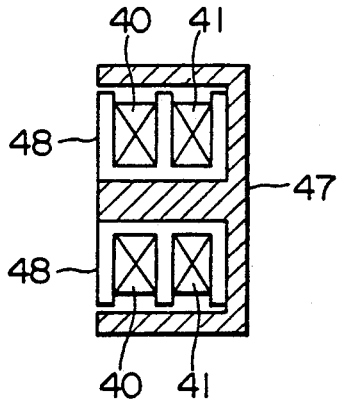

In the above instance, the receiving coils and the exciting coils are separately formed. However, those may be assembled into a single core as shown in FIGS. 13 an 14. FIG. 13 shows a coil arrangement in which coils 40 and 41 respectively wound on bobbins 45 and 46 are disposed in an integrally formed core (44'). In FIG. 13, a couple of coil assemblies of the receiving and exciting coils thus arranged are disposed on both sides of the coin path, with the coil 40 of each coil assembly facing the coin path. In a coil assembly shown in FIG. 14, a bobbin 48 wound by coils 40 and 41 is assembled into a unit core 47. A couple of the coil assemblies are disposed on both sides of a coin path through which a coin passes, with the coil 40 of each assembly facing the coin path.

The coil 5 for detecting the diameter of coins is made up of an exciting coil mounted on one side wall of the first rail 3R and a receiving coil mounted on the other side wall, as will subsequently be described. The diameter of the coin is recognized on the basis of a level change of an output voltage of the receiving coil. The mounting position of the coil 5 is deviated from the first rail 3R by a predetermined distance in order to make it easy to recognize the coin diameter.

Description to follow is an elaboration of a circuit arrangement to determine the type of the coin 22 by using the receiving coils 40A and 40B and the exciting coils 41A and 41B.

Figure 15:
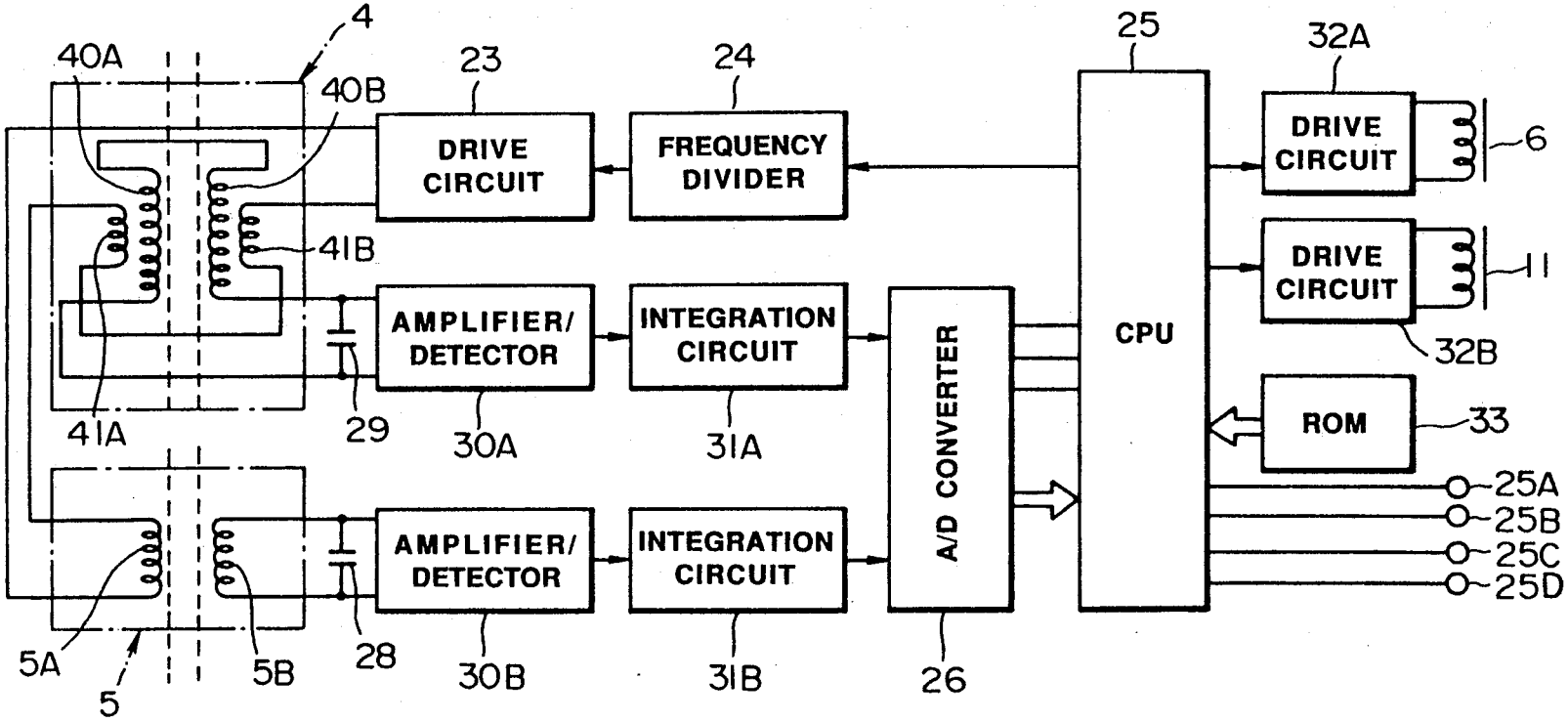
FIG. 15 shows a circuit diagram of an example of a circuit for recognizing the material and diameter of a coin.

FIG. 15 shows an embodiment of a circuit for determining the properties of a coin put into a coin path, such as material, size and surface conditions of the coin. The first receiving coil 40A, first exciting coil 41A, second receiving coil 40B, and second exciting coil 41B make up a property coil 4 for detecting the properties of a coin. The exciting coils 41A and 41B for exciting the property detecting coil 4 and the exciting coil 5A for exciting the diameter-detecting coil 5 are connected in series, and then connected to the output of a drive circuit 23. The drive circuit 23 receives an AC exciting signal of 20 to 60 kHz, for example, that is derived from a frequency divider 24. The frequency divider 24 frequency divides a pulse signal of a reference frequency outputted from a central processing unit (CPU) 25 into the signal at 20 to 60 kHz. The drive circuit 23 amplifies the AC exciting signal and supplies it to the exciting coils 41A, 41B and 5A. The AC exciting signal may be a signal of a sinusoidal wave or a signal of a nonsinusoidal wave such as a rectangular wave, triangle wave and a saw-tooth signal.

The receiving coils 40A and 40B of the property-detecting coil 4 are connected in series and then connected in parallel to a capacitor 29 for parallel resonance. The capacitor 29, which is inserted in the series circuit of the coils 40A and 40B, is connected across the input of an amplifier/detector circuit 30A.

The receiving coil 5B for the diameter detecting coil 5 is coupled in parallel with a capacitor 28 for parallel resonance which is further coupled across the input of an amplifier/detector circuit 30B.

The amplifier/detector 30A amplifies and detects a high frequency signal induced in the series circuit made up of the receiving coils 40A and 40B, and outputs an envelope of the high frequency signal.

Figure 16:
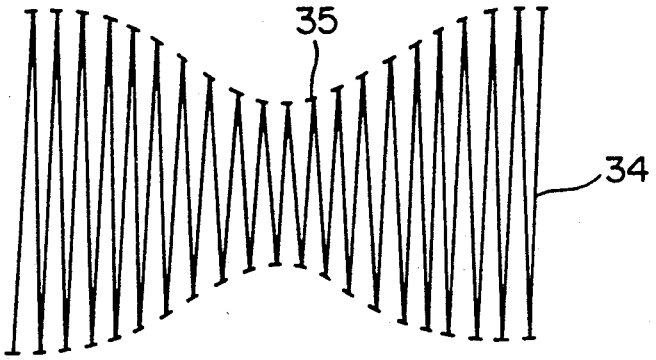
FIG. 16 shows a waveform of an output signal of a receiving coil when a coin is put into a coin path.

FIG. 16 shows an example of a waveform of a high frequency induced in the series circuit of the receiving coils 40A and 40B. The high frequency signal indicates a state of the coin 22 that is passing through the coin path 3. The amplifier/detector circuit 30A amplifies and detects the high frequency signal 34 and extracts a variation in an envelope 35 of the high frequency signal 34. The output signal of the circuit 30A is inputted into an integration circuit 31A.

Figure 8:
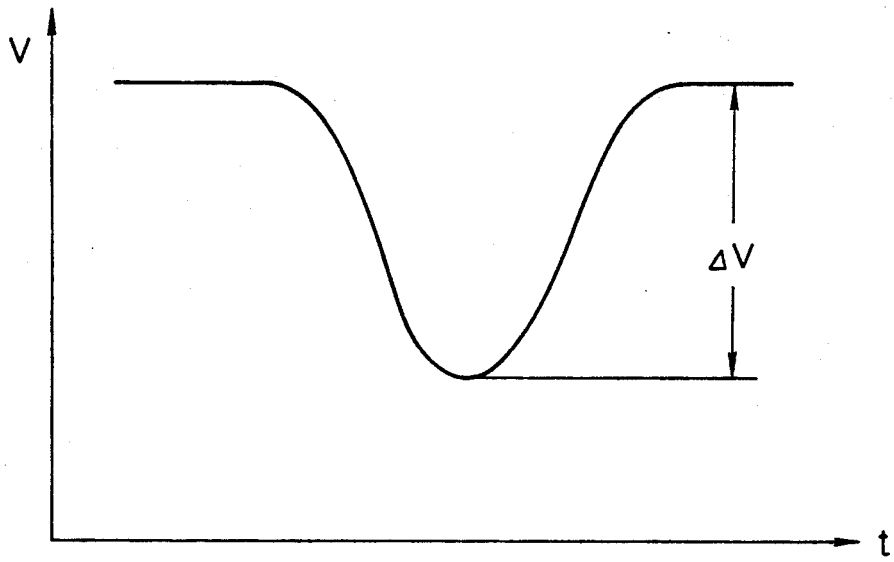
Figure 17:
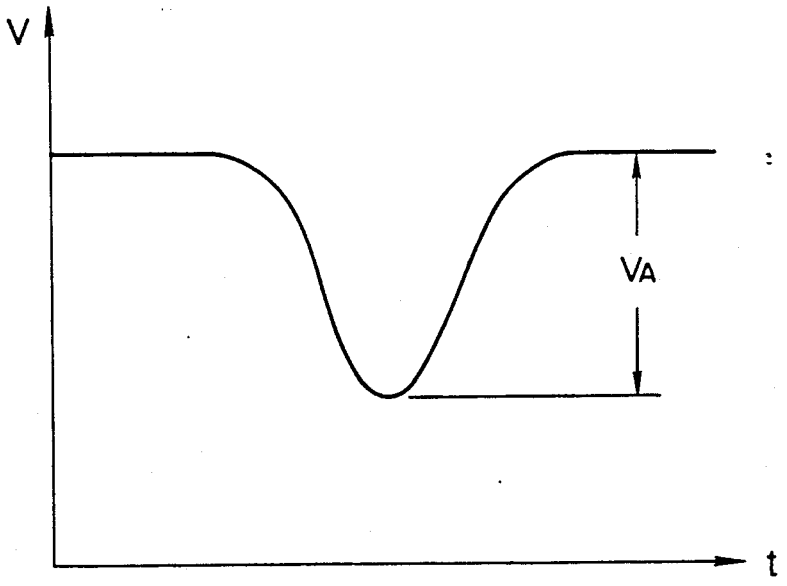
FIG. 17 shows a waveform of an output signal of an integrating circuit when a coin is put into a coin path.

The integration circuit 31A integrates the detected signal of the amplifier/detector circuit 30A, to form a voltage signal corresponding to the detected signal. An example of the voltage signal outputted from the integration circuit 31A is illustrated in FIG. 17. The voltage signal shown in FIG. 17 corresponds to the high frequency signal shown in FIG. 8. A voltage $V_A$ in FIG. 17 shows a voltage drop due to the passage of the coin 22. The output signal of the integration circuit 31A is converted into a corresponding digital signal by an A/D converter 26 and is applied to the CPU 25.

Similarly, an output signal of the receiving coil 5B is amplified and detected by the amplifier/detector circuit 30B, and is integrated by the integration circuit 31B, and converted into a corresponding digital voltage signal by the A/D converter 26, and finally inputted into the CPU 25.

The CPU 25 decides the properties of the coin 22 on the basis of an amount of the drop of each of the induced voltages in the receiving coils 40A and 40B that is caused by the passage of the coin 22. The CPU 25 also decides the diameter of the coin 22 o the basis of an amount of the drop of the induced voltage in the receiving coil 5B. The programs for the decision of the properties and the diameter of the coin and the data concerning a level to discriminate the amounts of the voltage drop are stored in a read only memory (ROM) 33.

After deciding that the properties and the diameter of the coin, the CPU 25 decides if the passing coin 22 is true or false. If it is true, the CPU 25 drives a true/false selecting solenoid 6 through a solenoid driver 32A. Further, the CPU 25 decides the type of denominations A, B, C or D of the coin 22. If the coin 22 belongs to the denominations A or B, the CPU 25 drives a denomination selecting solenoid 11 by a solenoid drive circuit 32B.

Interface terminals 25A to 25D of the CPU 25 are for driving devices such as a display.

Figure 18:
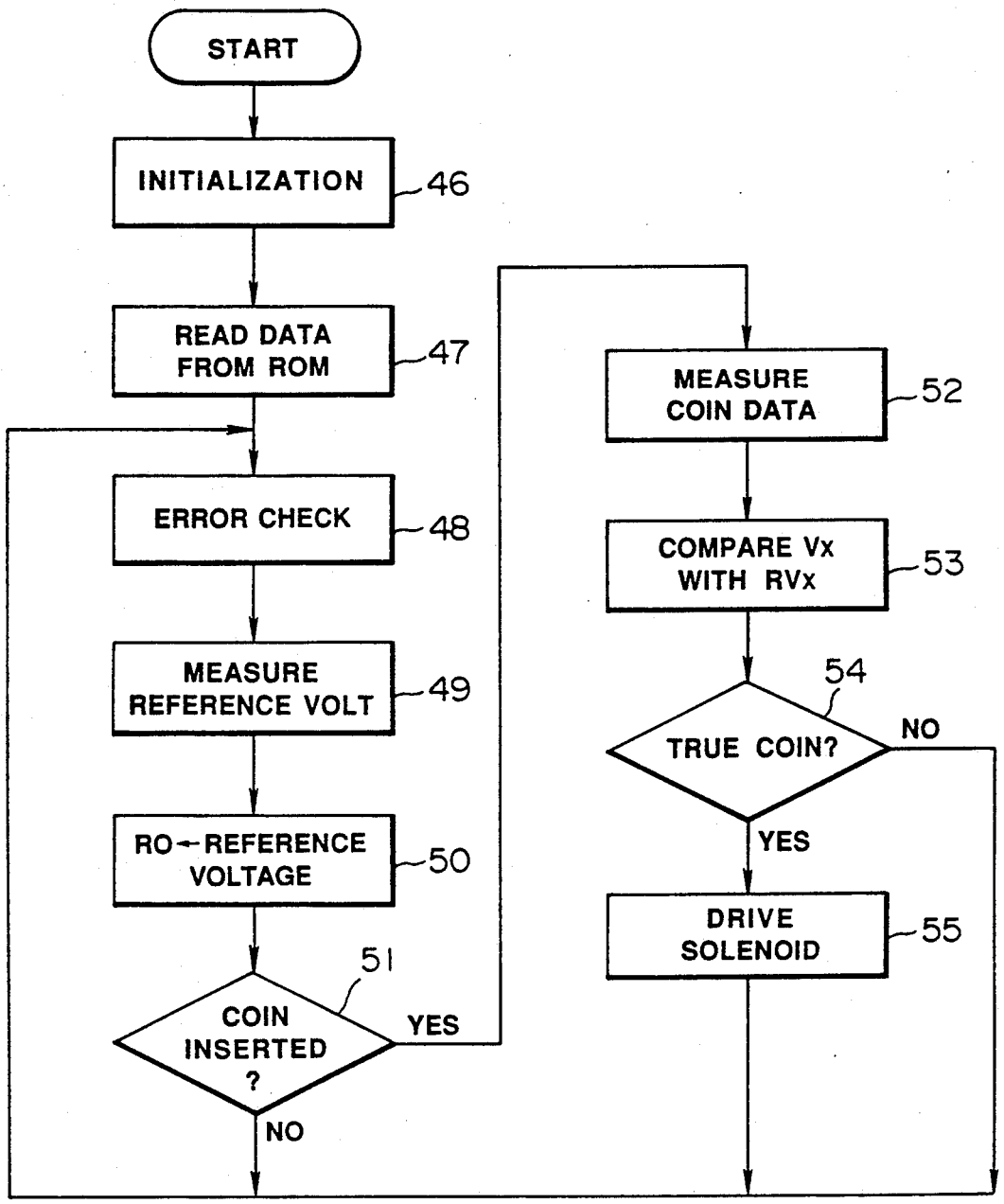
FIG. 18 shows a flowchart showing a processing to recognize the material of a coin.

FIG. 18 shows a flowchart showing a processing flow to recognize passing coins that is executed by the CPU 25.

The operation of the circuit of FIG. 15 will be described with reference to the above flowchart.

When a power supply is turned on, the CPU 25 initialize internal registers and the like, and fetches various types of data for coin recognition from the ROM 33 (steps 46 and 47). After this, the CPU 25 makes an error check as to whether or not an erroneous drive signal is applied to the denomination solenoid 11 and the like.

For the error check, the output signal of the A/D converter 26 in a stand-by mode is measured as a reference voltage signal (steps 48 and 49). The measurement of the voltage signal of the A/D converter 26 in the stand-by mode is made to detect an amount of the output voltage drop of the A/D converter 26 that results from the inserting of a coin, in the form of a value relative to the value of the reference voltage signal in the stand-by mode. That measurement ensures an exact detection of an amount of the output voltage drop of the A/D converter 26 that is caused by the passage of the coin, regardless of a variation of the power source voltage and an aging of the exciting coils 41A and 41B.

After the output voltage (reference voltage) of the A/D converter 26 in the stand-by mode is loaded into the internal register R0, the CPU 25 waits for another coin to be inputted (steps 50 and 51).

When the coin 22 is inputted from the slot 2, the CPU 25 starts to collect the coin data (step 52). The exciting coils 41A and 41B, and 5A are excited by an exciting signal outputted from the drive circuit 23. As a result, predetermined voltages are induced in the receiving coils 40A, 40B and 5B through magnetic couplings with the corresponding exciting coils. A coin 22 is put into the coin path, and passes the locations of those receiving coils 40A, 40B and 5B. The passage of the coin 22 changes the magnetic fluxes acting on the receiving coils 40A, 40B and 5B which are magnetically coupled with the exciting coils 41A, 41B and 5A, and consequently changes the induced voltage in the receiving coils 40A, 40B and 5B. The amounts of these voltage changes depend on the properties and diameter of the passing coin. If the passing coin is true, the voltage change is determined by values proper to the true coin of each denomination.

The output voltages of the receiving coils 40A, 40B and 5B are respectively amplified and detected by the amplifier/detector circuits 30A and 30B and integrated by the integration circuits 31A and 31B. As a result, the integration circuits 31A and 31B produce respectively voltage signals each varying as shown in FIG. 17 in accordance with the denomination of the coin 22. The CPU 25 fetches the variations of the output signals of the integration circuits 31A and 31B that results from the coin passage, in the form of coin data. An amount of the voltage change $V_X$ (X represents the denominations of coins A to D) of each of the output signals of the integration circuits 31A and 31B is compared with reference values $RV_X$ representing the amount of voltage change for each denomination of coins that are stored in and read out from the ROM 33, to find the denomination of the coin (steps 53 and 54).

If it turns out that the coin does not belong to any denomination and therefore the coin is a false coin, the solenoid 6 is not energized and the coin is discharged through a discharging slot. If it turns out that the coin belongs to one of the denominations A to D, the solenoid 6 is driven to lead the coin 22 to the true coin path 8. Then, if the coin belongs to the denominations of coins A or B, the solenoid 11 is driven to lead the coin to the path 12A or 12B. If the coin belongs to the denomination C or D, the solenoid 11 is not driven, and the coin is led to the path 12C or 12D (step 55).

The combination of the exciting coil 41A and receiving coil 40A and the combination of the exciting coil 41B and the receiving coil 40B are oppositely disposed with respect to the side walls 3A and 3B of the coin path (first rail 3R). Accordingly, even if the coin 22 passes through the coin path along a path set aside to either of the side walls 3A and 3B, the sum of the induced voltages in the receiving coils 40A and 40B is always constant for the same denomination of passing coins.

Let us consider a case, for example, that the coin 22 passes along a path closer to the side wall 3A in the coin path and that an amount of the induced voltage drop in the receiving coil 40A is increased and becomes larger than that caused when the coin 22 passes along a path extending at the center of the coin path. In this case, an amount of the induced voltage drop in the receiving coil 40B is decreased by a value corresponding to the increase in the receiving coil 40A. Therefore, the sum of the induced voltages in the receiving coils 40A and 40B is constant. Thus, correct voltage is detected regardless of the path the coin 22 takes in the coin path.

With the arrangement of the coin selector as mentioned above, if in place of a cladding coin in which a core layer of copper is laminated with a cupro-nickel layer, such as coins of 10 and 25 cent, and one dollar that are currently used in the U.S.A., a coin of copper whose outer configuration and the thickness are the same as those of the cladding coin is inputted, the coin selector according to the present invention may readily recognize the copper coin. Thus, according to the embodiment, the difference between the cladding coin and the copper coin is distinctly observed. Therefore, the coin selector may correctly sort the cladding coin and the copper coin.

Figure 21:
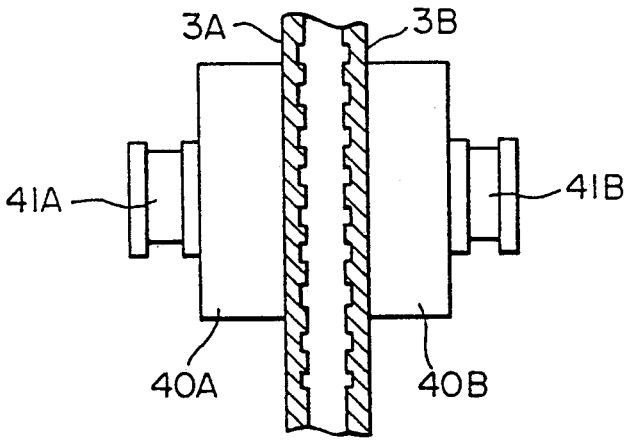
FIG. 21 is a sectional view showing another example of a side wall of a coin path to which a coil for recognizing a coin material is mounted.

The arrangement of the coin selector eliminates a necessity for slanting the coin path to slide coins on either of the side walls of the coin path. Accordingly, the coin path for detecting the coin may be arrayed vertically. Therefore, no dusty materials are deposited on the coin path. Further, a passing coin, even if it is wet, will smoothly travel in the coin path. FIG. 21 shows the irregular surfaces of the side walls 3A and 3B of the coin path on which the coil 4 is disposed for preventing a wet coin from sticking to the side wall surfaces.

Further, according to the embodiment, only two groups of coils, the property detecting coil 4 and the diameter detecting coil 5, are disposed at the first rail 3R. Therefore, the rail may be substantially shortened.

In the above-mentioned embodiment, the exciting coils 41A and 41B for the property detecting coil 4 and the exciting coil 5A for the diameter detecting coil 5 are connected in series, and are energized by the single drive circuit 23. Accordingly, a frequency of an exciting signal applied to the exciting coils 41A and 41B is equal to that of an exciting signal applied to the exciting coil 5A of the diameter detecting coil 5.

Alternatively, the exciting coils 41A and 41B for the property detecting coil 4, and the exciting coil 5A of the diameter detecting coil 5 may be arranged in parallel and coupled with the drive circuit 23. Those coils may be energized by different drive circuits, respectively.

Further, although the exciting coils 41A and 41B are connected in series and energized by one drive circuit 23, if required, these exciting coils may be connected in parallel to the drive circuit 23. Further, these coils may be driven by two independent drive circuits.

The receiving coils 40A and 40B, that are connected in series in the above-mentioned embodiment, may be connected in any manner so long as the voltages induced in those coils are summed and applied to the amplifier/detector circuit 30A.

Although the pairs of the exciting and receiving coils 40A and 41A, 40B and 41B are aligned and face with each other, these pairs of the coils may be disposed out of the alignment so long as the paired coils satisfy a predetermined magnetic coupling relationship. Further, relative position of the exciting coil and the receiving coil in each pair may be changed so long as they are magnetically coupled with each other with a magnetic coupling strength greater than a predetermined level.

The same thing is true for the alignment of each coil in the paired coils.

Figure 19:
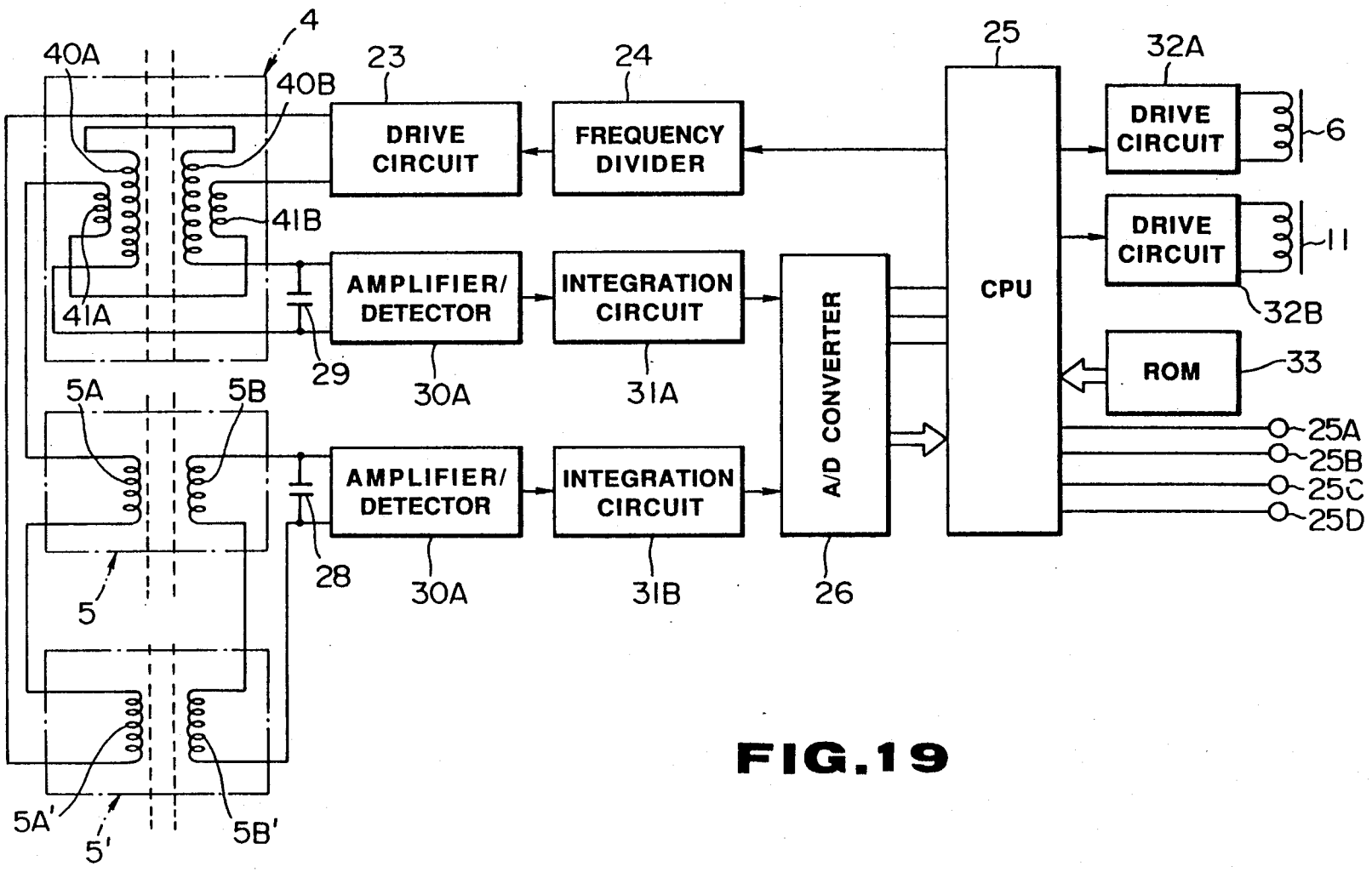
FIG. 19 is a circuit diagram of another embodiment of a circuit for recognizing the material and diameter of a coin.
Figure 20:
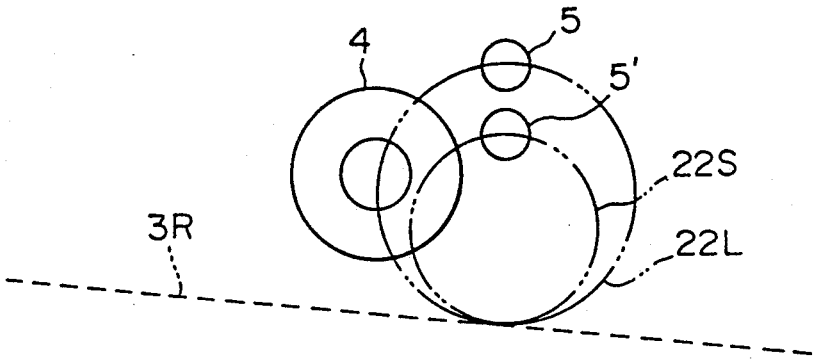
FIG. 20 is a diagram showing an array of coils for recognizing a coin diameter in the embodiment shown in FIG. 19.

FIG. 19 is a block diagram showing a modification of the coin selector. In the modification, two coils 5 and 5' are used for the coil for detecting the diameter of a coin. Structurally, as shown in FIG. 20, the first coil 5 is disposed at a location suitable for detecting a large coin 22L having the maximum diameter. The second coil 5' is located at the best place to detect a small coin 22S of the minimum diameter. With the use of the two coils for the diameter detecting purpose, the diameters of the coils may be reduced. The diameter reduction reduces a space required for disposing the property detecting coils and the diameter detecting coils. As a result, the size of the coin selector may be further reduced.

What is claimed is:

1. A coin selector comprising:

a first receiving coil disposed along a coin path;

a first exciting coil so disposed as to magnetically couple with said first receiving coil;

a second receiving coil disposed with its coil winding axis aligned with the coil winding axis of said first receiving coil with respect to said coin path;

a second exciting coil so disposed as to magnetically couple with said second receiving coil;

drive means for driving said first and second exciting coils; and judging means for judging a coin passing through said coin path on the basis of a signal representing the sum of the output signals of said first and second receiving coils.

2. The coin selector according to claim 1, in which a winding of said first exciting coil is aligned with a winding of said first receiving coil; and a winding of said second exciting coil is aligned with a winding of said second receiving coil.

3. The coin selector according to claim 2, in which said first receiving coil is a first pot type coil structured such that a coil wound around a first bobbin is disposed in a first pot type core, said second receiving coil is a second pot type coil structured such that a coil wound around a second bobbin is disposed in a second pot type core, said first exiting coil is a third drum type coil wound around a third drum type core, said second exciting coil is a fourth drum type coil wound around a fourth drum type core, said third drum type coil is laid on said first pot type coil, and said fourth drum type coil is laid on said second pot type coil.

4. The coin selector according to claim 2, in which said first receiving coil and said first exciting coil are respectively coils wound around first and second bobbins and disposed in a first core, and said second receiving coil and said second exciting coil are respectively coils wound around third and fourth bobbins and disposed in a second core.

5. The coin selector according to claim 1, in which said first and second receiving coils are aligned with each other.

6. The coin selector according to claim 1, in which said first and second receiving coils are so connected as to form a series circuit, and said judging means judges a coin on the basis of an output signal of the series circuit of said first and second receiving coils.

7. The coin selector according to claim 6, in which a capacitor is connected in parallel with the series circuit of said first and second receiving coils.

8. The coin selector according to claim 1, in which said first and second receiving coils are so connected as to form a series circuit, and said drive means includes a single drive source for driving the series circuit of said first and second receiving coils.

9. The coin selector according to claim 1, in which said drive means drives a series circuit of said first and second exciting coils by an AC exciting signal at a predetermined frequency.

10. The coin selector according to claim 9, in which said AC exciting signal is a signal of a sinusoidal wave.

11. The coin selector according to claim 9, in which said AC exciting signal is a signal of a nonsinusoidal wave.

12. The coin selector according to claim 1, in which said first and second exciting coils act on said first receiving coil, and said second and first exciting coils act on said second receiving coil.

13. The coin selector according to claim 9, in which said judging means includes a detector circuit for detecting a signal representative of the sum of the output signals of said first and second receiving coils, an integration circuit for integrating the output signal of said detector circuit, and a comparing means for comparing a level of the output signal of said integration circuit with a preset threshold level so as to judge the coin.

14. The coin selector according to claim 1, in which said coin path is arranged substantially vertically.

15. A coin selector comprising:

a first receiving coil disposed along a coin path;

a first exciting coil so disposed as to magnetically couple with sad first receiving coil;

a second receiving coil disposed with its coil winding axis aligned with the coil winding axis of said first receiving coil with respect to said coin path;

a second exiting coil so disposed as to magnetically couple with said second receiving coil;

drive means for driving said first and second exciting coils;

coin diameter detecting means disposed along said coin path for detecting a diameter of a coin passing through said coin path; and judging means for judging a coin by determining properties of a coin passing through said coin path on the basis of a signal representing the sum of the output signals of said first and second receiving coils, and by determining a diameter of the coin passing through said coin path on the basis of an output of said diameter detecting means.

16. The coin selector according to claim 15, in which said coin diameter detecting means includes a third receiving coil disposed along said coin path, a third exciting coil disposed in opposition to said third receiving coil with respect to said coin path, an output signal of said third receiving coil is used for detecting the diameter of a passing coin.

17. The coin selector according to claim 16, in which said first, second and third exciting coils are driven by a single drive source.

18. The coin selector according to claim 16, in which said third receiving coil and said third exciting coil are positioned at such locations as to detect the diameters of coins whose diameters are the largest and smallest of those coins to be sorted.

19. The coin selector according to claim 15, in which said coin diameter detecting means includes a third receiving coil disposed along said coin path, a third exciting coil magnetically coupled with said third receiving coil, a fourth receiving coil disposed in opposition to said third receiving coil with respect to said coin path,. fourth exciting coil magnetically coupled with said fourth receiving coil, and a signal representing the sum of output signals of said third and fourth receiving coils is used for detecting the diameter of a passing coin.

20. The coin selector according to claim 19, in which said third and fourth exciting coils are driven by a single drive means.

21. The coin selector according to claim 19, in which said third receiving coil, said third exciting coil, said fourth receiving coil and said fourth exciting coils are positioned at such locations as to detect the diameters of coins whose diameters are the largest and smallest of those coins to be sorted.

22. The coin selector according to claim 15, in which said coin diameter detecting means includes a third receiving coil disposed along said coin path, a third exciting coil magnetically coupled with said third receiving coil, a fourth receiving coil disposed along said coin path, a fourth exciting coil disposed in opposition to said fourth receiving coil with respect to said coin path, and a signal representing the sum of output signals of said third and fourth receiving coils is used for detecting the diameter of a passing coin.

23. The coin selector according to claim 22, in which said third and fourth exciting coils are driven by a single drive means.

24. The coin selector according to claim 22, in which said third receiving coil and said third exciting coil are positioned at such locations as to detect the diameter of coins whose diameter is the largest of those coins to be selectively sorted, and said fourth receiving coil and said fourth exciting coil are positioned at such locations as to detect the diameter of coins whose diameter is the smallest of those coins to be sorted.

* * * * *